US006595800B2

(12) United States Patent
Yuasa et al.

(10) Patent No.: US 6,595,800 B2
(45) Date of Patent: Jul. 22, 2003

(54) WATERPROOF CONNECTOR

(75) Inventors: Katsuhiko Yuasa, Yokohama (JP); Norio Murata, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/903,191

(22) Filed: Jul. 10, 2001

(65) Prior Publication Data

US 2002/0006747 A1 Jan. 17, 2002

(30) Foreign Application Priority Data

Jul. 13, 2000 (JP) ..... 2000-213529

(51) Int. Cl.[7] ..... H01R 13/40

(52) U.S. Cl. ..... 439/587; 439/274; 439/275; 439/588

(58) Field of Search ..... 439/528, 587–589, 439/274–279, 148–149, 163, 301, 475, 710, 157, 595

(56) References Cited

U.S. PATENT DOCUMENTS

| | | | | | |
|---|---|---|---|---|---|
| 2,932,685 | A | * | 4/1960 | Raila et al. | 174/84 C |
| 3,818,420 | A | * | 6/1974 | Barr | 439/261 |
| 3,989,338 | A | | 11/1976 | Gosser | |
| 4,084,875 | A | * | 4/1978 | Yamamoto | 439/274 |
| 4,944,688 | A | * | 7/1990 | Lundergan | 439/275 |
| 4,973,298 | A | * | 11/1990 | Ferguson | 493/85 |
| 4,998,896 | A | | 3/1991 | Lundergan | |
| 5,538,441 | A | * | 7/1996 | Paolucci et al. | 439/589 |
| 5,542,856 | A | * | 8/1996 | Wood | 439/281 |
| 6,176,739 | B1 | * | 1/2001 | Denlinger et al. | 439/589 |
| 6,341,983 | B1 | * | 1/2002 | Crawford et al. | 439/587 |

FOREIGN PATENT DOCUMENTS

| | | |
|---|---|---|
| EP | 0625807 | 11/1994 |
| JP | 06036824 | 2/1994 |
| JP | 07065894 | 3/1995 |
| JP | 11354201 | 12/1999 |
| JP | 2000040550 | 2/2000 |
| JP | 2001006799 | 1/2001 |
| WO | WO98/37609 | 8/1998 |

* cited by examiner

*Primary Examiner*—Tho D. Ta
*Assistant Examiner*—Larisa Tsukerman
(74) *Attorney, Agent, or Firm*—W. F. Fasse; W. G. Fasse

(57) ABSTRACT

A waterproof connector includes a housing in which a terminal is to be held, having an opening on its terminal insertion side, a sealing member inserted in the opening of the housing, having a sealing part, which is provided on the outer circumference of the sealing member and airtightly contacts the inner surface of the opening, and having a plurality of through holes, each of which allows a terminal to pass through and each of which has a respective inner surface that is able to airtightly contact an electric wire, and covers provided for the respective through holes, a circumferential part of each of the covers being integrally connected over the entire circumference to the circumferential wall of the through hole, and the circumferential part being formed into a thickness that can be broken by human force.

16 Claims, 12 Drawing Sheets

COMPARATIVE EXAMPLE

WATERPROOF CONNECTOR

BACKGROUND OF THE INVENTION

1. Field of the Invention

The present invention belongs to a technical field of waterproof connectors, and particularly relates to a waterproof connector wherein a plurality of terminals can be inserted into a housing and collectively waterproofed.

2. Related Art

A collectively-waterproofed type connector is known wherein an opening in a housing on its terminal insertion side is sealed with a sealing member and a wired terminal is inserted in each of a plurality of through holes in this sealing member and all the terminals are collectively waterproofed. This collectively-waterproofed type connector has a merit that the connector of this type can be compactified more easily than an individually-waterproofed-cell type connector wherein a housing is provided with a number of cells corresponding to the number of terminals and every individual cell and its terminal are sealed by inserting a sealing member into the cell. When such a collectively-waterproofed type connector is used to make a waterproof connector of which number of poles is smaller than its originally-designed number of poles, each through hole that is not to be used is fitted with a plug to close the hole. When a waterproof connector is provided with separate plugs, it may result in an increase in cost. Moreover, such a work of manually inserting each plug into a through hole is quite troublesome and deteriorates the workability. To solve this problem, some waterproof connectors have been proposed, such as one disclosed in Japanese Patent unexamined publication gazette Heisei 6-36824, wherein a retainer for holding a sealing member in a housing is provided with plugs that can be cut off and a through hole into which a terminal is to be inserted is made open by cutting its plug off the retainer.

As the technique of this proposal is for waterproof connectors having a retainer for holding a sealing member, it can not be applied to a waterproof connector wherein a sealing member is inserted into an opening in a housing on its terminal insertion side as described above. Moreover, parts functioning as plug of the waterproof connector of the proposal are to be formed integrally with the retainer. In this case, the retainer, which is required to have a rigidity sufficient to hold the sealing member, is usually made of a resin, etc., and the work of opening a through hole by cutting a part functioning as plug away from the retainer at a connecting part of the resin, etc. will require a considerable force, and its workability is bad. Furthermore, the need of the two-stage operation of opening a through hole by cutting off a part functioning as plug and inserting a terminal poses a problem of troublesomeness.

SUMMARY OF THE INVENTION

The present invention is designed for a collectively-waterproofed type connector wherein a sealing member is inserted into an opening in a housing on its terminal insertion side. One object of the invention is to ease the work of opening a through hole, by integrally connecting covers for closing through holes onto the sealing member and, when necessary, breaking a cover to open a through hole. Another object of the present invention is to make it possible to insert a wired terminal into the waterproof connector with a single touch by making each cover breakable by the pressing force of a terminal to open a through hole.

To accomplish the above-mentioned objects, the waterproof connector of the present invention comprises a housing in which a terminal is to be held, having an opening on its terminal insertion side, a sealing member inserted in the opening of the housing, having a sealing part, which is provided on the outer circumference of the sealing member and airtightly contacts the inner surface of the opening, and having a plurality of through holes, each of said through holes allowing a terminal to pass through and the inner surface of each of said through holes being able to airtightly contact an electric wire, and covers provided for the respective through holes, a circumferential part of each of the covers being integrally connected over the entire circumference to the circumferential wall of the through hole, and the circumferential part being formed into a thickness that can be broken by human force.

When this waterproof connector is to be used, a cover that closes a through hole into which a terminal is to be inserted is pulled outwards away from the sealing member or a wired terminal is forced into a cover that closes a through hole into which a terminal is to be inserted to pull inwards the cover from the sealing member. The cover will be broken at its circumferential part under the effect of the tensile force, shearing force, etc., and the cover will come off the sealing member to open the through hole. Then the wired terminal is inserted into this opened through hole. As a through hole that is not to be inserted with a terminal is closed without any gap by a cover that is integrally connected, the waterproof connector is waterproofed from the outside. As the cover is integrally connected to the sealing member, there is no need of separately providing any plug. This reduces the cost, and as the work of manually inserting plug into the through hole is eliminated, the workability is improved. As the cover is integrally connected with the sealing member, the cover is formed out of rubber, etc. of which tensile strength and shearing strength are lower than those of resins and the like. Thus the work of pulling and breaking the covers can be done more easily, and the required force for the work is smaller than that required for cutting the part functioning as plug away from the retainer, and the workability is improved. When a cover is to be removed by pushing a wired terminal into the cover, the wired terminal can be inserted into the waterproof connector with a single touch.

This waterproof connector is one of the collectively-waterproofed type wherein a sealing member is inserted into an opening in the housing on its terminal insertion side, and as the need of separately providing a plug is eliminated, the cost can be reduced, and as the work of manually inserting a plug into a through hole is eliminated, the workability can be enhanced. Moreover, the workability of opening a through hole can be improved significantly in comparison to the work of cutting off a part functioning as a plug from the retainer. Furthermore, when a cover is to be removed by pushing a wired terminal into the cover, the wired terminal can be inserted into the waterproof connector with a single touch, and the workability of installing the wired terminal is enhanced.

BRIEF DESCRIPTION OF THE DRAWINGS

FIG. 3A is a side view,

FIG. 3B is a front view, and

FIG. 3C is a rear view, respectively.

FIG. 4A shows a state before insertion, and

FIG. 4B shows a state after insertion, respectively.

FIG. 7A is a side view,

FIG. 7B is a front view, and

FIG. 7C is a rear view, respectively.

FIG. 10A is a side view,

FIG. 10B is a front view, and

FIG. 10C is a rear view, respectively.

PREFERRED EMBODIMENTS OF THE INVENTION

Figure 1:
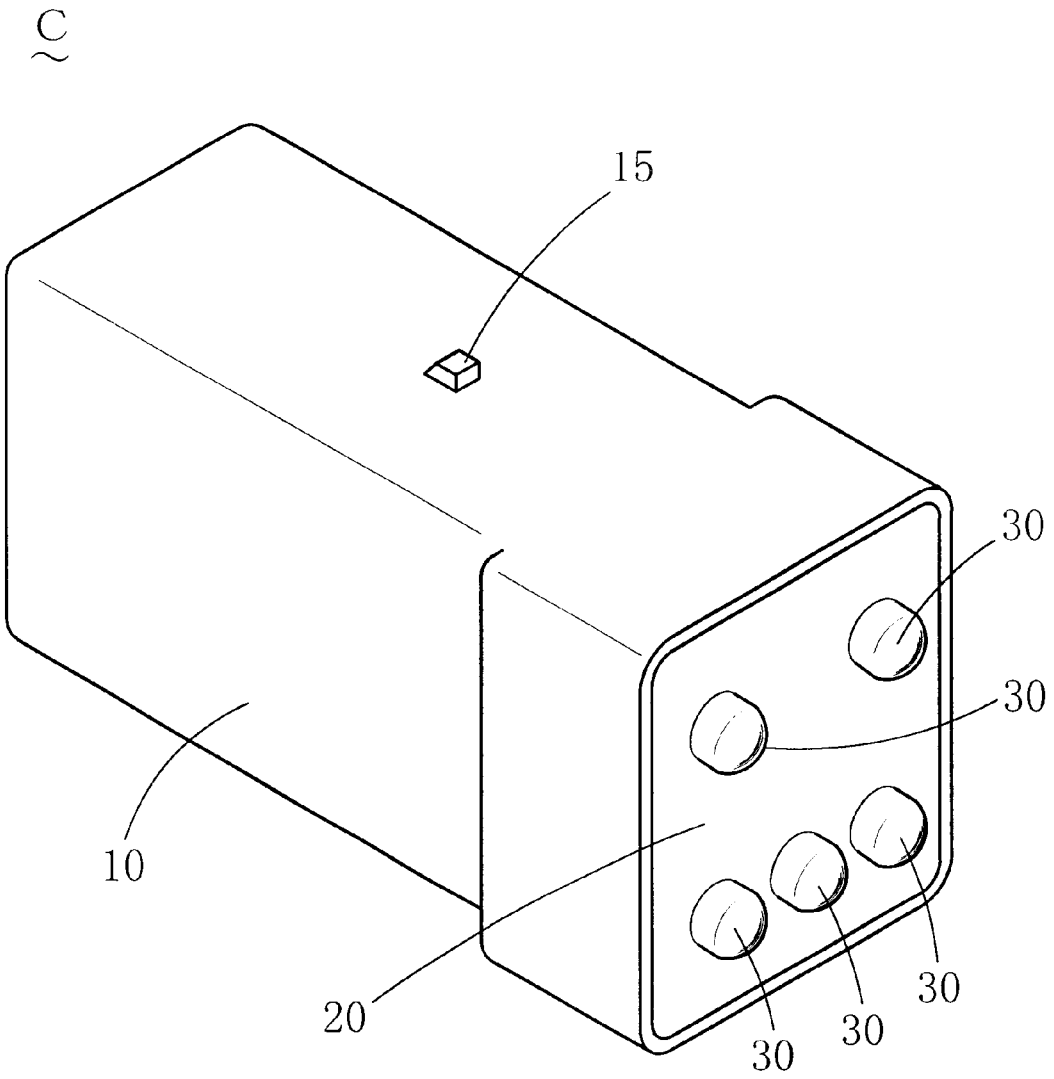
FIG. 1 is a perspective view of a waterproof connector according to the first embodiment of the present invention.
Figure 2:
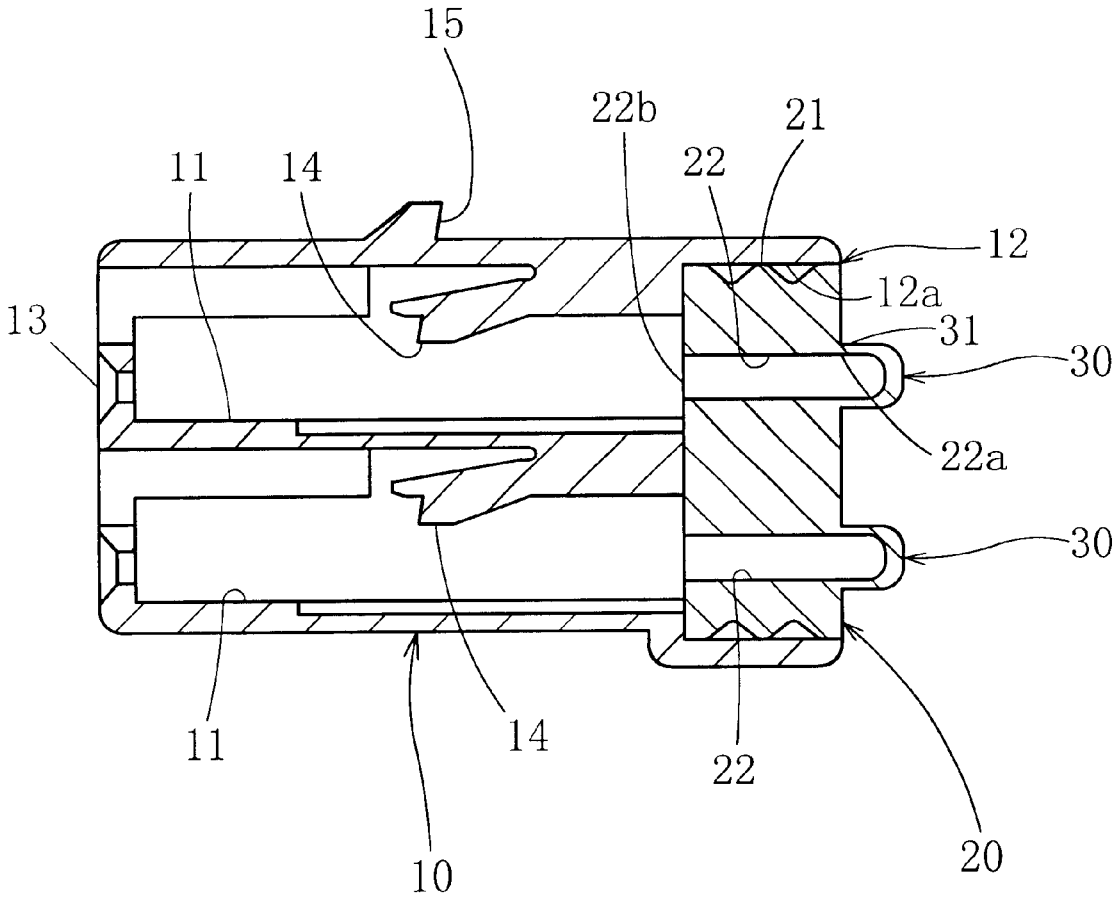
FIG. 2 is a longitudinal sectional view of the above-mentioned waterproof connector.

In the following, embodiments of the waterproof connector according to the present invention will be described. FIG. 1 and FIG. 2 show a waterproof connector C according to the first embodiment. When an electric wire H is attached to a terminal T and the wired terminals T are inserted into this waterproof connector C and the waterproof connector C into which the terminals T have been inserted and a counterpart waterproof connector (not illustrated) are engaged together with a seal ring or the like inbetween, terminals of both connectors will be airtightly connected with each other in the housings of both waterproof connectors. In this embodiment, up to five terminals can be inserted. The number of poles of the waterproof connector of the present invention, however, is not limited in any way by this embodiment.

Figure 10A:
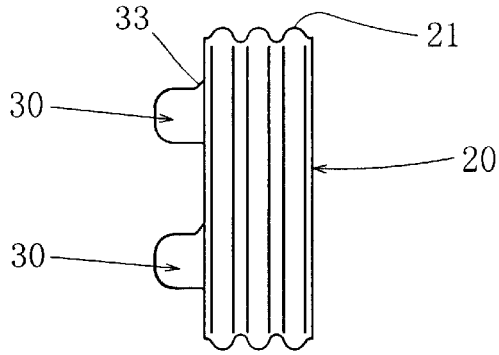
FIG. 10A, FIG. 10B and FIG. 10C show a sealing member with covers in the waterproof connector of the fifth embodiment.
Figure 10B:
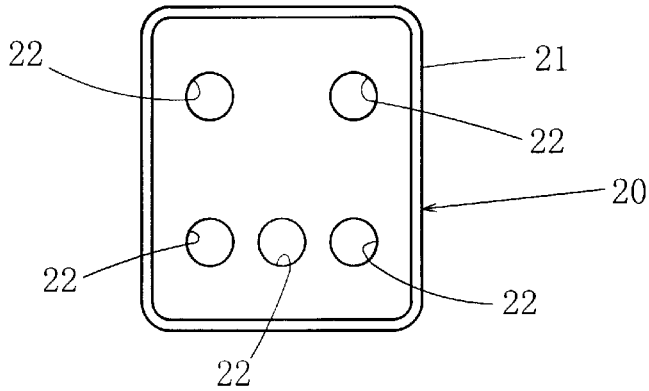
Figure 10C:
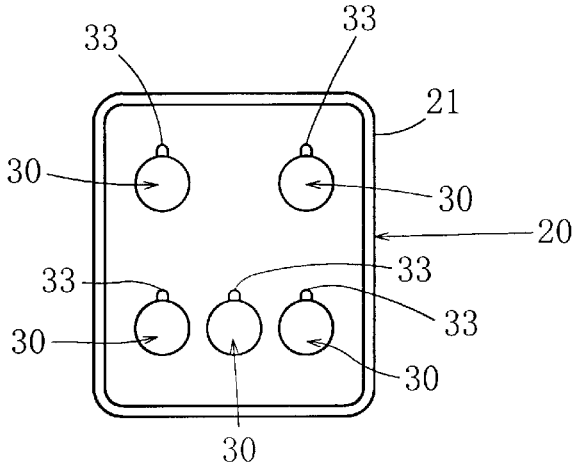

In FIG. 1 and FIG. 2, 10 denotes a housing of the waterproof connector C, and this housing 10 is formed of an insulating material into a roughly box-shaped form. Inside the housing 10, a plurality of cells 11 are formed to hold terminals T. An opening 12 of the terminal insertion side is formed in one end of the housing 10, and the respective cells 11 are connected to this opening 12. Openings 13 of the connection side are formed in the other end of the housing 10 and each cell 11 is connected to an opening 13. In this embodiment, each cell 11 is provided with a dedicated opening 13, but a plurality of cells may be connected to a single opening of the connection side. Each terminal T is made to connect to a terminal of the counterpart waterproof connector through an opening 13. The terminals T of this embodiment are female terminals of a roughly boxed form, but the present invention also covers waterproof connector into which male terminals are inserted. The terminals T of this embodiment are crimp terminals, but terminals T are not limited in any way to crimp terminal.

Figure 3A:
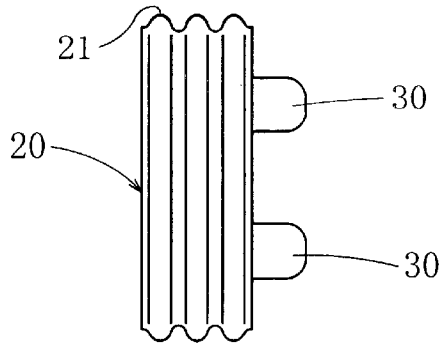
FIG. 3A, FIG. 3B and FIG. 3C show a sealing member with covers in the above-mentioned waterproof connector.
Figure 3B:
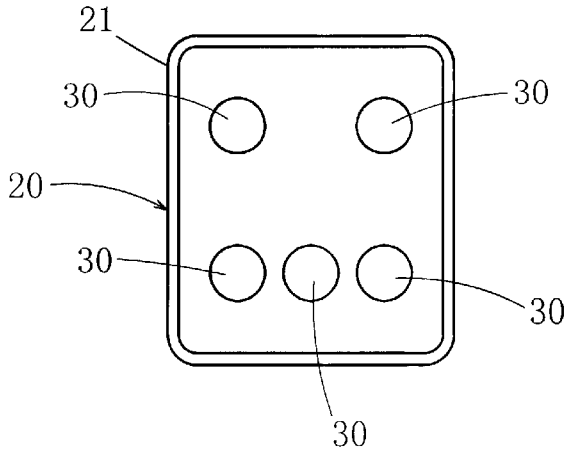
Figure 3C:
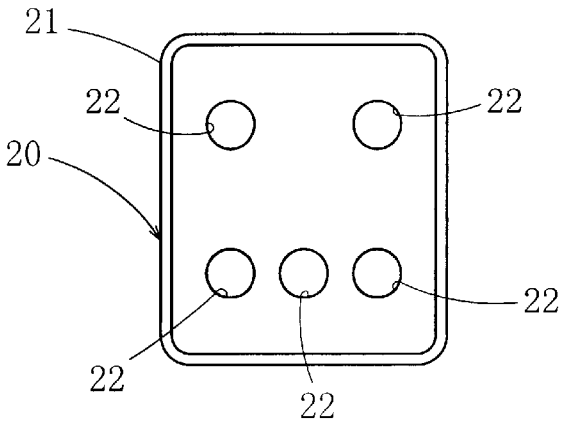

The opening 12 in the housing 10 is formed to have a certain depth in the insertion direction of terminals T. A sealing member 20 having sealability is inserted into this opening 12. As shown in FIG. 3A, FIG. 3B and FIG. 3C, the sealing member 20 is formed of an elastic material that exhibits airtightness such as rubber, and is formed in such a way that it fits into the above-mentioned opening 12 in a little compressed state due to its elasticity. The sealing member 20 has, on its outer circumference, a sealing part 21 that airtightly contacts the inner surface 12*a* of the above-mentioned opening 12. In this embodiment, seal lips are formed on the sealing part 21, but the sealing part 21 may be formed flat. The sealing member 20 has a plurality of through holes 22, each of the through holes 22 allowing a terminal T to pass through and the inner surface of each of the through holes 22 being able to airtightly contact an electric wire H. Each of these through holes 22 can be expanded to an extent that when a terminal T is inserted, the terminal T can pass through it thanks to the elasticity of the sealing member 20. When an electric wire H is put through the through hole 22, its internal surface will elastically contact the electric wire H due to the elasticity of the sealing member 20 to exhibit sealability.

This sealing member 20 is provided with a cover 30 for each through hole 22. The circumferential part 31 of this cover 30 is integrally connected over the entire circumference to the circumferential wall of the through hole 22. The cover 30 may be arranged in any position along the through hole 22; it may be arranged on the outer end, the inner end or in the middle of the through hole 22. In this embodiment, the cover 30 is arranged on the outer end 22*a* of the through hole 22. As a result, the circumferential part 31 of the cover 30 is integrally connected over the entire circumference to the circumferential wall of the through hole 22 at the outer end 22*a* thereof. The form of the cover 30 is not specifically limited. However, in this embodiment, the cover 30 is made to protrude outwards beyond the outer surface of the sealing member 20, and the cover 30 is formed into an approximately bowl shape.

The circumferential part 31 of the cover 30 is formed to have a thickness that can be broken by human physical power. In other words, the circumferential part 31 is formed to have a thickness that can be broken when a human force is exerted to the cover 30. The human force that is exerted to the cover 30 includes tensile forces that work in the insertion direction of the terminals T or in the direction opposite to it, shearing forces that act in a direction perpendicular to the insertion direction of the terminals T, and forces that are combinations of the former and the latter. In the first embodiment, the thickness that can be broken by human force is a thickness that can be broken by tensile force, shearing force, etc. when the cover 30 is pulled by human power outwards from the sealing member 20. When this thickness is determined, the material of the cover 30 is considered. 14 denotes a lance for engaging a terminal T and is provided when necessary. The present invention includes embodiments wherein terminals T are provided with a lance. 15 denotes a locking part for engaging the waterproof connector to a counterpart waterproof connector. It is provided when necessary.

The thickness of the circumferential part 31 of the cover 30 is formed to be thinner than those of other portions of the cover 30.

Figure 4A:
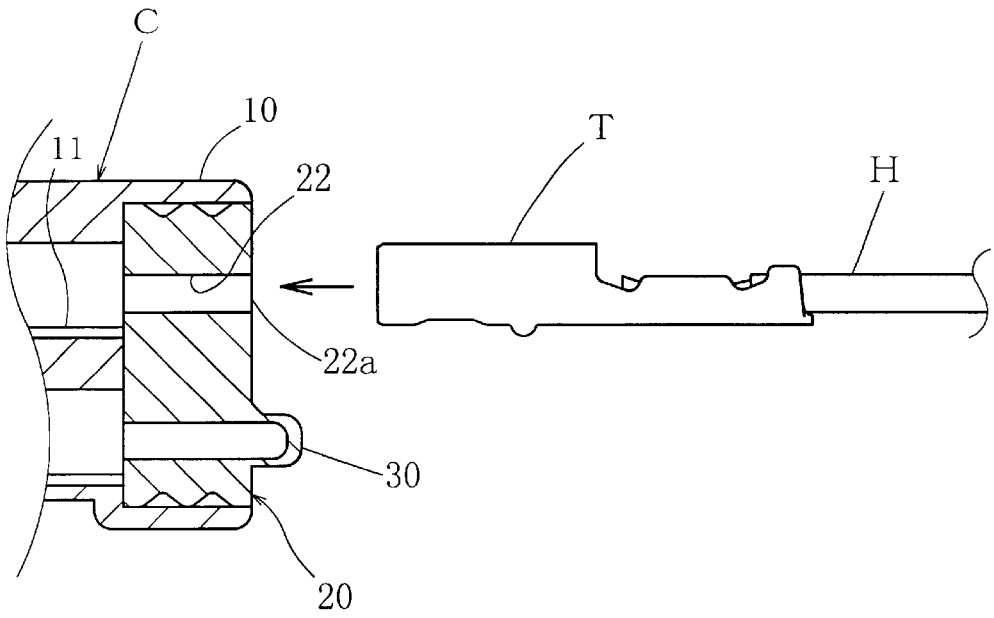
FIG. 4A and FIG. 4B are explanatory drawings showing steps of inserting a wired terminal into the above-mentioned waterproof connector.
Figure 4B:
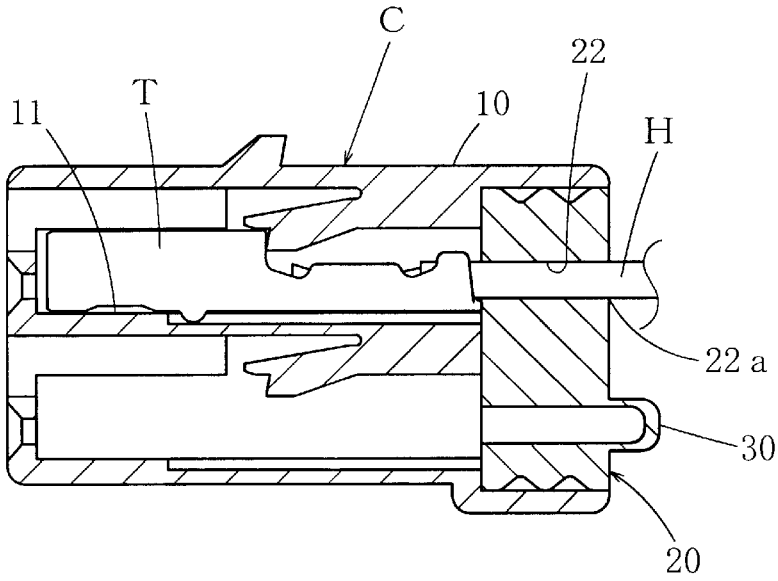

Accordingly, when the waterproof connector C according to the first embodiment is used, as shown in FIG. 4A, a cover 30 closing a through hole 22 into which a terminal T is to be inserted is pulled outwards from the sealing member 20. Under tensile force and shearing force, the cover 30 will be broken in the circumferential part 31 and the cover 30 will come off the sealing member 20 to open the through hole 22. As shown in FIG. 4B, a wired terminal T is inserted into this opened through hole 22. As through holes 22 into which no terminal T is to be inserted are closed without any gap by covers 30 that are integrally connected over entire circumference to the circumferential walls of through holes 22, they are completely waterproofed against the outside of the waterproof connector C. The number of broken cover(s) and unbroken cover(s) of the waterproof connector of the present invention are not limited by this embodiment.

Figure 12:
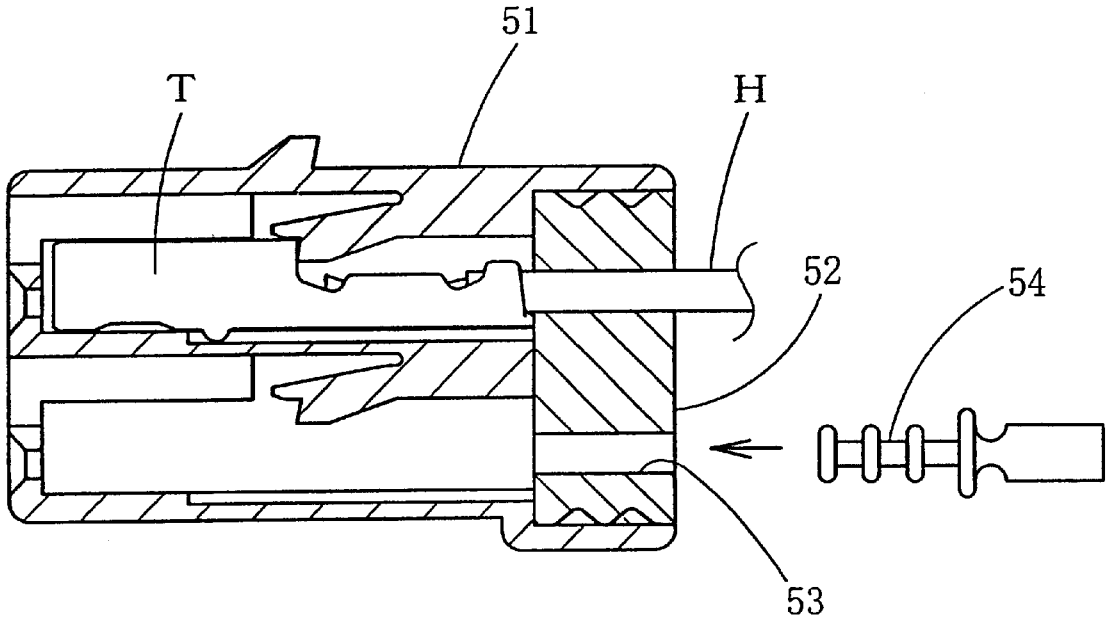
FIG. 12 is an explanatory drawing showing steps of inserting a wired terminal into a comparative example of a waterproof connector that differs from the present invention.

FIG. 12 shows a comparative example of a waterproof connector that differs from the present invention, for the purpose of being compared with the present invention. This waterproof connector comprises a housing 51 having a construction similar to that of the first embodiment, and a sealing member 52 which is inserted into an opening in the housing 51 on its terminal insertion side, which has on its outer circumference a sealing part that airtightly contacts the inner surface of the above-mentioned opening, and which has a plurality of through holes 53 through which terminals can be passed and of which internal surfaces airtightly contact electric wires. A plug 54 is inserted into every through hole 53 that is not to be used. In comparison with the connector of FIG. 12, the waterproof connector C of the first embodiment has no need of separately providing plugs 54 as covers 30 are integrally connected to the sealing member 20. Hence the cost is reduced. Moreover, as the work of manually inserting a plug 54 into a through hole 22 and breaking away an end portion of the plug 54 is eliminated, the workability is improved.

In the waterproof connector C of the first embodiment, as the covers 30 are integrally connected with the sealing member 20, the covers 30 are formed of rubber or the like of which tensile strength and shearing strength are lower than those of resins or the like, and the work of breaking the covers 30 is easier. Accordingly, the force required to break a cover 30 in the waterproof connector C according to the first embodiment is significantly smaller than that required in the work of cutting a part functioning as plug away from a retainer in the technique proposed in Japanese Patent unexamined publication gazette Heisei 6-36824; thus the workability is improved.

In the waterproof connector C of the first embodiment, as covers 30 protrude outwards beyond the outer surface of the sealing member 20, when a cover 30 is to be pulled outwards away from the sealing member 30, it is easier to hold the cover 30; thus the workability is improved.

The present invention does not limit in any way the thickness of the circumferential part of the cover. However, when the thickness of the circumferential part 31 of the cover 30 is made thinner than other portions of the cover 30 as is the case in the waterproof connector C of the first embodiment, stresses tend to concentrate in the circumferential part 31 of the cover 30, and the cover 30 will reliably break at the circumferential part 31. Hence the cover 30 can be removed neatly to open a neat through hole 22.

Figure 5:
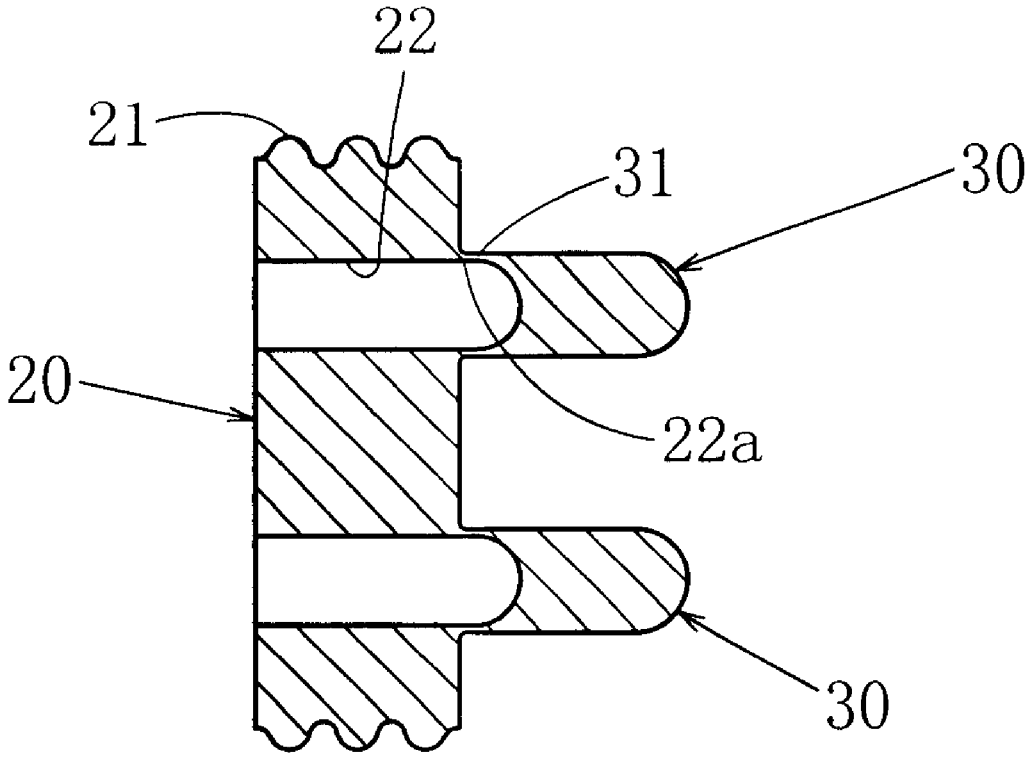
FIG. 5 is a longitudinal sectional view showing a sealing member with covers in a waterproof connector according to the second embodiment of the present invention.

The waterproof connector C of the second embodiment will be described. The waterproof connector C of the second embodiment differs from the waterproof connector C of the first embodiment only in the form of the covers 30. Accordingly, the same reference number is given to the respective same member as in the first embodiment, and the entire description of the first embodiment applies here as well, while only points of difference regarding the form of the covers 30 will be described. As shown in FIG. 5, each cover 30 of the second embodiment includes a solid protruding nub, i.e. each cover is formed solid except for its circumferential part 31. Morever, the amount of protrusion of the cover 30 outwards from the external surface of the sealing member 20 is set longer than the cover 30 of the first embodiment.

With the arrangements of the second embodiment, actions and effects that can be obtained in the first embodiment can be obtained. Furthermore, when the cover 30 is formed solid except its circumferential part 31, the stress concentration to the circumferential part 31 of the cover 30 will be more conspicuous, and the cover 30 will be more reliably broken at its circumferential part 31, and in turn, the cover 30 will be removed neatly to open a neater through hole 22. Because the cover 30 of this second embodiment protrudes farther outward away from the external surface of the sealing member 20, it is easier to grasp and hold the cover 30 so as to be able to pull the cover 30 outward away from the sealing member 20 for separating the cover 30 from the sealing member 20. Thus the workability is improved.

Figure 6:
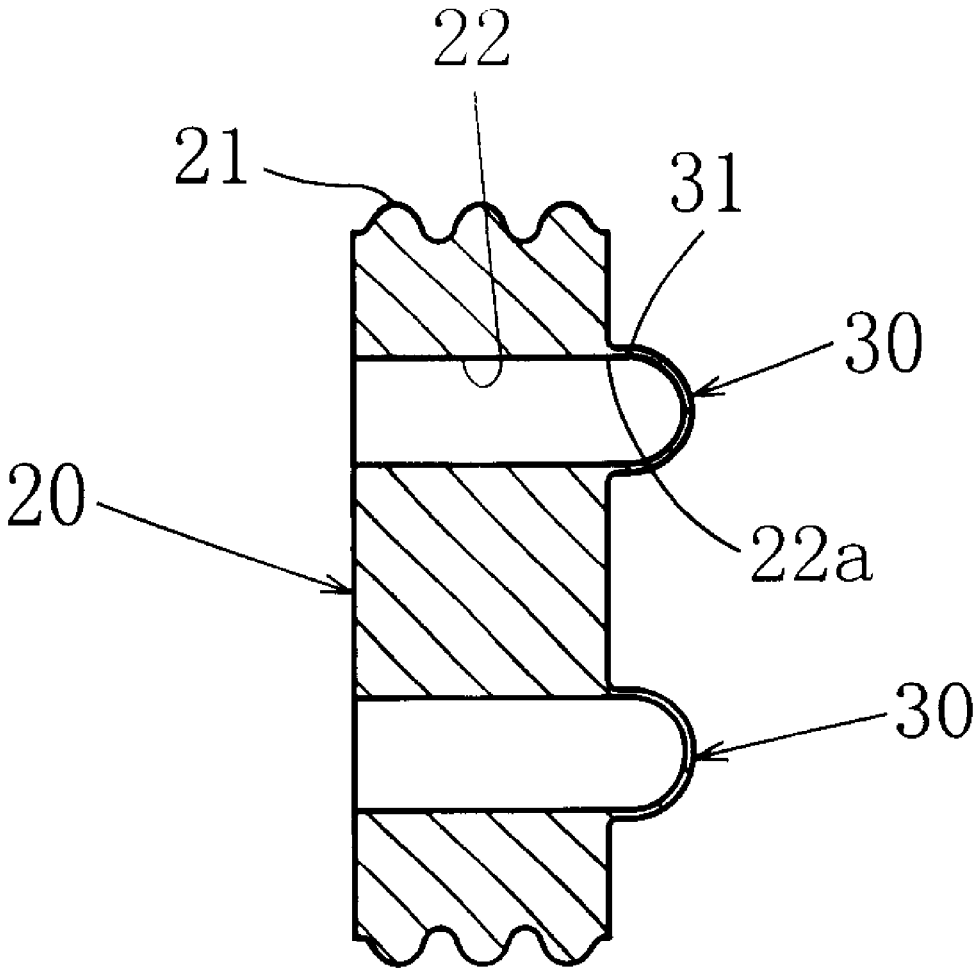
FIG. 6 is a longitudinal sectional view showing a sealing member with covers in a waterproof connector according to the third embodiment of the present invention.
Figure 7A:
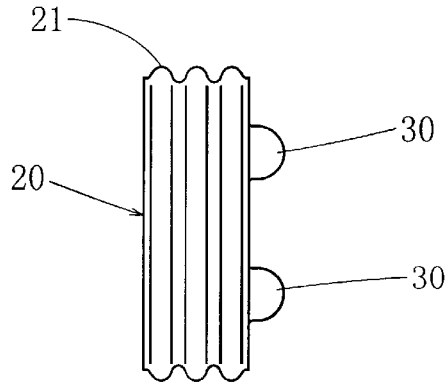
FIG. 7A, FIG. 7B and FIG. 7C show a sealing member with covers in a waterproof connector according to the fourth embodiment of the present invention.
Figure 7B:
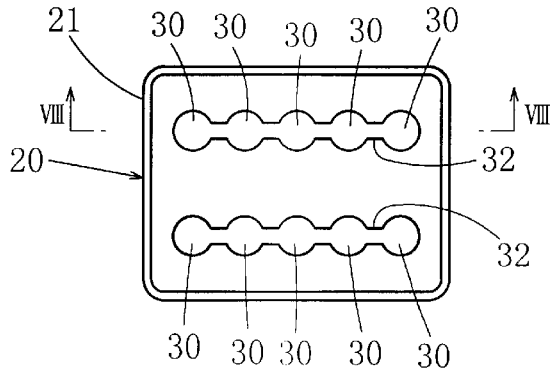
Figure 7C:
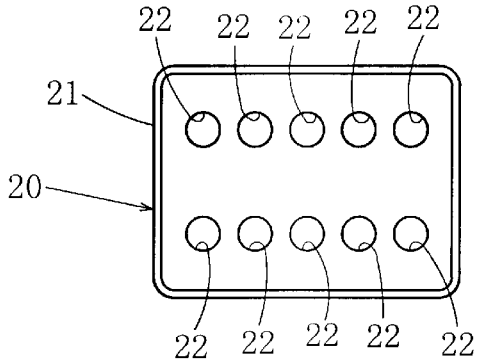
Figure 8:
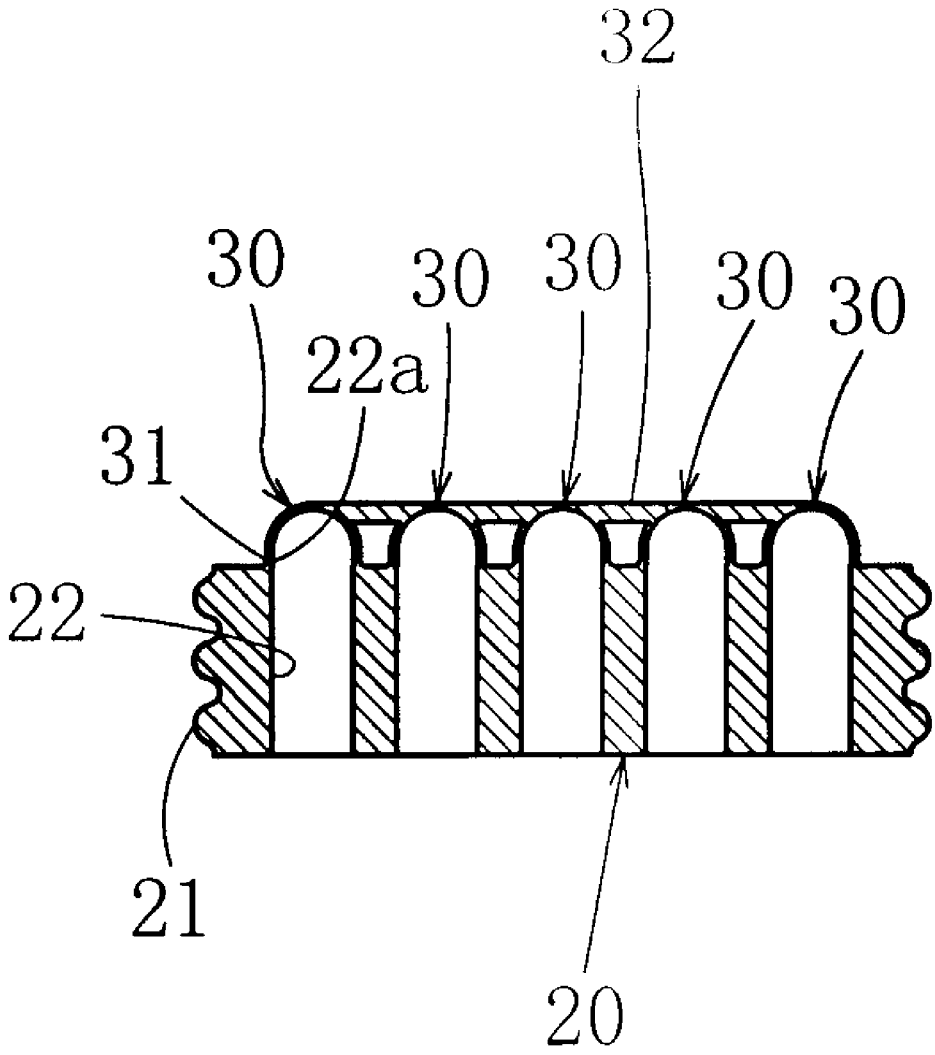
FIG. 8 is a sectional view along a line VIII—VIII in FIG. 7B.
Figure 9:
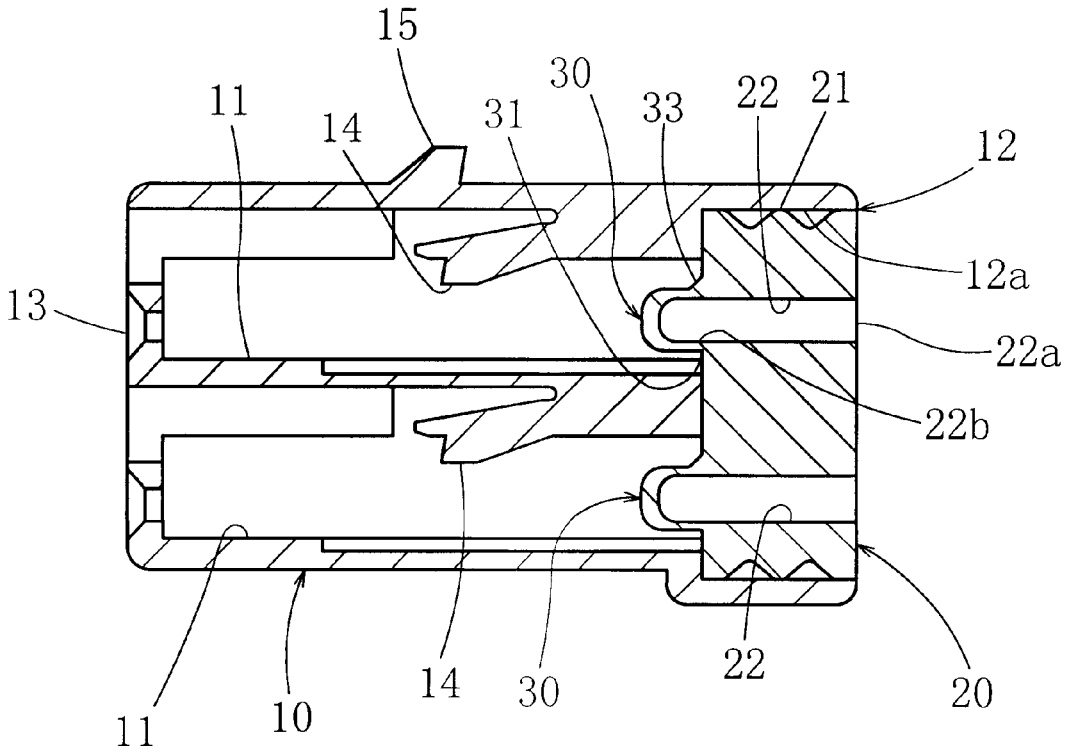
FIG. 9 is a longitudinal sectional view of a waterproof connector of the fifth embodiment of the present invention.

The waterproof connector C of the third embodiment will be described. The waterproof connector C of the third embodiment differs from the waterproof connector C of the first embodiment only in the form of the covers 30. Accordingly, the same reference number is given to the respective same member as in the first embodiment, and the entire description of the first embodiment applies here as well, while only points of difference regarding the form of the covers 30 will be described. As shown in FIG. 6, the covers 30 of the third embodiment are formed to a substantially even thickness.

With the arrangements of the third embodiment, actions and effects that can be obtained in the first embodiment can be obtained. In the third embodiment, as the sectional configuration changes between the circumferential part 31 of the cover 30 and the sealing member 20, stresses will be concentrated in the circumferential part 31 to break it. Thus the cover 30 will be removed from the sealing member 20.

The waterproof connector C of the fourth embodiment will be described. The waterproof connector C of the fourth embodiment has a larger number of poles than the waterproof connector C of the first embodiment. The waterproof connector C of the fourth embodiment substantially differs from the waterproof connector C of the first embodiment only in the form of the covers 30. Accordingly, the same reference number is given to the respective same member as in the first embodiment, and the entire description of the first embodiment applies here as well, while only points of difference regarding the form of the covers 30 will be described. As shown in FIG. 7A, FIG. 7B, FIG. 7C and FIG. 8, in the fourth embodiment, some covers 30 out of the total covers 30 are provided with connecting members 32 that are integrally connected to a plurality of covers 30 forming a respective interconnected group of covers 30. Through holes 22 corresponding to the respective group of covers 30 that are interconnected by the connecting members 32 are through holes 22 which are all jointly used as a group when they are to be used at all, and none of which is used when any one of them is not used. In other words, the through holes 22 associated with the interconnected covers 30 are either all used at the same time together or all not used and remain closed at the same time together. Here the connecting members 32 are formed into bars, but their forms are discretionary.

With the arrangements of the fourth embodiment, the actions and effects of the first embodiment can be obtained. Moreover, if a connecting member 32 is held and pulled, a plurality of covers 30 that are connected to the connecting member 32 will be removed from the sealing member 20 by one effort, and through holes 22 corresponding to these covers 30 will be opened by one effort. Thus the workability is good. The fourth embodiment is suitable when a combination of through holes 22 to be opened is definite.

The waterproof connector C of the fifth embodiment will be described. The waterproof connector C of the fifth embodiment differs from the waterproof connector C of the first embodiment only in the position of covers and the structure for connecting covers and the sealing member. Accordingly, the same reference number is given to the respective same member as in the first embodiment, and the description of the first embodiment applies here as well, while only the above-mentioned points of difference will be described. As shown in FIG. 9, FIG. 10A, FIG. 10B and FIG. 10C, in the fifth embodiment, each cover 30 is located at the inner end 22*b* of a through hole 22. Thus the circumferential part 31 of the cover 30 is integrally connected over the entire circumference to the circumferential wall of the inner end 22*b* of the through hole 22. The configuration of the cover 30 is not limited specifically, but in this embodiment, the cover 30 protrudes inwardly from the inner surface of the sealing member 20, namely, into the cell 12., and the cover 30 is formed approximately into a bowl shape.

The circumferential part 31 of the cover 30 is formed to a thickness that can be broken by human power. In other words, the circumferential part 31 is formed to have a thickness that can be broken when a human force is exerted to the cover 30. The human force that is exerted to the cover 30 includes tensile forces that work in the insertion direction of a terminal T. In the fifth embodiment, the thickness that can be broken by human power is a thickness that can be broken by tensile force, shearing force, etc. when a man pushes a wired terminal T into a cover 30 to pull the cover 30 inwards away from the sealing member 20. When this thickness is determined, the material of the cover 30 is considered.

The thickness of the circumferential part 31 of the cover 30 is made thinner than the thicknesses of other parts of the cover 30.

In the waterproof connector C of the fifth embodiment, a reinforcing part 33 is provided at a part of the circumferential part 31 of the cover 30. This reinforcing part 33 is thicker than other parts and connects the cover 30 other than its circumferential part and the circumferential wall of the through hole 22. The thickness of this reinforcing part 33 is set to a thickness that cannot be broken by human force.

Figure 11:
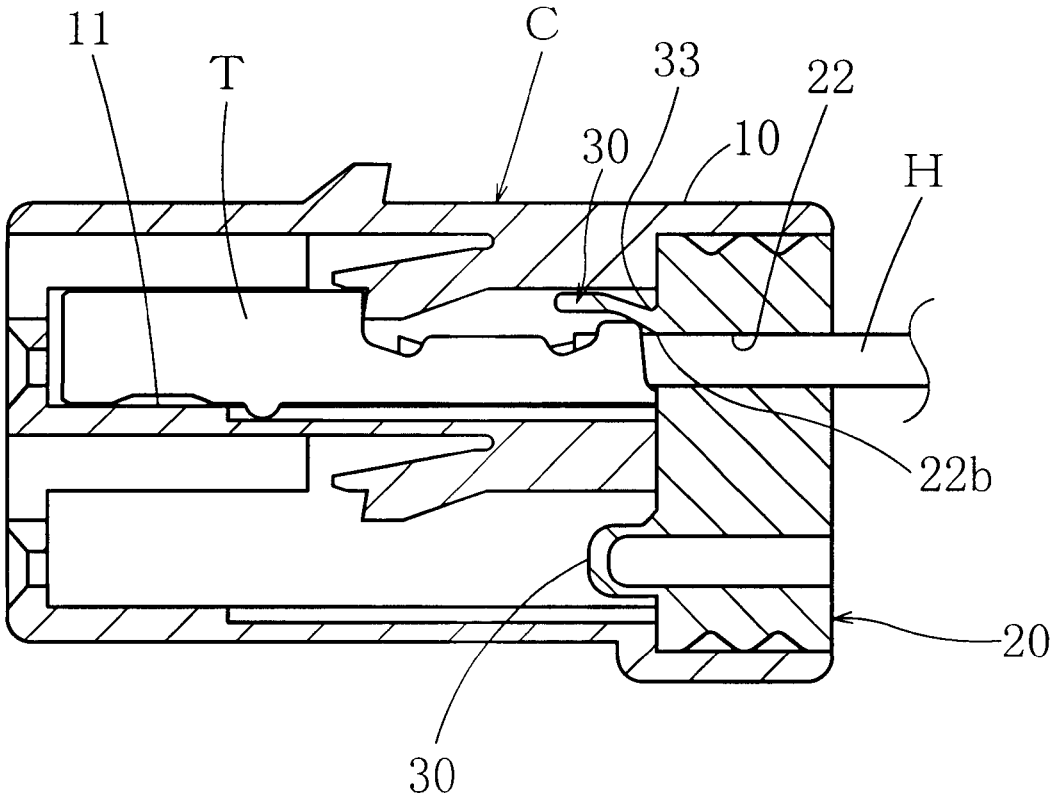
FIG. 11 is an explanatory drawing showing steps of inserting a wired terminal into the waterproof connector of the fifth embodiment.

Accordingly, when the waterproof connector C of the fifth embodiment is used, as shown in FIG. 11, a wired terminal T is pushed into a cover 30 closing a through hole 22 into which the terminal T is to be inserted, to pull the cover 30 inwards away from the sealing member 20. Under tensile force, shearing force, etc., the cover 30 will break at its circumferential part 31, and the cover 30 will come off the sealing member 20 to open the through hole 22. The wired terminal T will be directly inserted into this opened through hole 22. As through holes that are not to be inserted with terminals T are closed without any gap by covers 30 that are integrally connected over the entire circumference to the circumferential walls of the respective through holes, the waterproof connector C is completely waterproofed from the outside.

In the waterproof connector C of the fifth embodiment, as a cover 30 is removed by pushing a wired terminal T into the cover 30, the wired terminal T can be inserted into the waterproof connector C with a single touch; thus the workability of inserting a wired terminal T is excellent.

When compared with the connector of FIG. 12, the waterproof connector C of the fifth embodiment has covers 30 that are integrally connected to the sealing member 20. Hence there is no need of separately providing plugs 54, and this results in reduction in cost. Moreover, the work of manually inserting plugs 54 into through holes 22 and breaking the ends of the plugs 54 is eliminated, and this results in improvement in workability.

In the waterproof connector C of the fifth embodiment, the covers 30 are integrally connected to the sealing member 20, and the covers 30 are formed of rubber or the like of which tensile strength and shearing strength are lower than those of resins or the like. Hence breaking the covers 30 can be done more easily. Accordingly, the force required to break away the covers 30 in the waterproof connector C of the fifth embodiment is significantly smaller than the force required by cutting parts functioning as plug away from the retainer in the technique proposed in Japanese Patent unexamined publication gazette Heisei 6-36824, resulting in a better workability.

The present invention does not limit the thickness of the circumferential part of the covers, but when the thickness of the circumferential part 31 of the covers 30 is formed thinner than the thicknesses of other portions of the covers 30, like the case of the waterproof connector C of the fifth embodiment, stresses tend to concentrate in the circumferential part 31 of the covers 30 and the covers 30 will reliably break at their circumferential parts 31. As a result, the covers 30 will be removed neatly to open neat through holes 22.

In the waterproof connector C of the fifth embodiment, as a reinforcing part 33 is provided in a portion of the circumferential part 31 of each cover 30, the reinforcing part 33 will not break even when the other portions of the circumferential part 31 are broken, and the cover 30 will be kept connected to the sealing member 20 by means of the reinforcing part 33. As a result, the cover 30 will never be lost in or out of the waterproof connector C. Thus covers 30 are prevented from causing troubles such as defective contact by dropping into the contacting parts of terminals.

The present invention includes all embodiments that combine features of the above-mentioned embodiments. The present invention includes, for example, embodiments wherein connecting members are provided to the first embodiment through the third embodiment and the fifth embodiment, embodiments wherein reinforcing parts are provided to the first embodiment through the fourth embodiment, an embodiment wherein no reinforcing parts are provided in the fifth embodiment, and embodiments wherein covers are provided at the inner ends of through holes like the case of the fifth embodiment and the form of the covers is the cover form of the second embodiment or the third embodiment. The present invention includes an embodiment wherein the covers are provided in the middle of through holes and the circumferential part of each cover is integrally connected over the entire circumference to the internal wall of the through hole and the circumferential part of each cover is formed to have a thickness that is breakable by human force, an embodiment wherein covers are made to protrude outwards from the external surface of the sealing member in this embodiment, an embodiment wherein connecting members are provided in this embodiment, and an embodiment wherein reinforcing parts are provided in this embodiment.

With the description of these embodiments, the first waterproof connector that was described in Summary above has been fully disclosed. Moreover, with the description of these embodiments, the second waterproof connector through the fifth waterproof connector that will be described below have been fully explained.

The second waterproof connector is a waterproof connector according to the first waterproof connector, wherein the covers protrude outwards away from the external surface of the sealing member. With this arrangement, when a cover is to be pulled outwards away from the sealing member, the cover can be easily held, thus the workability of opening a through hole is improved.

The third waterproof connector is a waterproof connector according to the first waterproof connector or the second waterproof connector, wherein the thickness of the circumferential part of each cover is formed to be thinner than the thicknesses of other portions of the cover. With this arrangement, stresses can be easily concentrated in the circumferential part of the cover, and the cover will reliably break at its circumferential part. As a result, the cover will be removed neatly to open a neat through hole.

The fourth waterproof connector is a waterproof connector according to any one of the first waterproof connector through the third waterproof connector, further comprising a connecting member or connecting members integrally connected to some covers out of the total covers. With this arrangement, when a connecting member is held and pulled, a plurality of covers that are connected to the connecting member will be removed from the sealing member by one effort to open the corresponding through holes by one effort. Thus the workability of opening through holes is enhanced, and the fourth waterproof connector is appropriate when a combination of through holes to be opened is definite.

The fifth waterproof connector is a waterproof connector according to any one of the first waterproof connector through the fourth waterproof connector, further comprising reinforcing parts, each of which is provided at a part of the circumferential part of the cover, is thicker than other parts, and connects the cover other than its circumferential part and the circumferential wall of the through hole. With this arrangement, when parts other than the circumferential part are broken, the reinforcing part will not break, and the cover will be kept connected to the sealing member by means of the reinforcing part. As a result, the cover will never be lost in or out of the waterproof connector. Thus covers are prevented from causing troubles such as defective contact by dropping into the contacting parts of terminals.

What is claimed is:

1. A waterproof electrical connector comprising:

a housing with a cavity therein adapted to receive an electrical terminal, and an opening of said housing that communicates into said cavity; and a sealing member including a sealing member body that is inserted in a sealed manner into said opening of said housing, and that has at least one through hole passing therethrough into said cavity, and including at least one seal cover respectively allocated to said at least one through hole;

wherein:

each said through hole is adapted to receive therein in a sealed manner an electric wire connected to the electrical terminal;

each respective said seal cover includes a seal cover central portion and a seal cover circumferential portion that entirely circumferentially surrounds said central portion and that integrally connects said central portion to a circumferential rim of a respective said through hole at an end of said respective through hole at a surface of said sealing member body, so that said circumferential portion and said central portion together form said respective seal cover as a continuous closed cover that is integral with said sealing member body and that closes said respective through hole in an initial first condition of said waterproof electrical connector;

said circumferential portion of each said respective seal cover has a thickness that can be broken by applying a human force to said respective seal cover; and said central portion of each said respective seal cover protrudes from said surface of said sealing member body away from said sealing member body.

2. The waterproof electrical connector according to claim 1, wherein said surface is an external surface of said sealing member body facing outwardly away from said cavity of said housing, and wherein said central portion of each said respective seal cover protrudes outwardly from said external surface in a direction away from said cavity of said housing.

3. The waterproof electrical connector according to claim 1, wherein said surface is an inner surface of said sealing member body facing inwardly into said cavity of said housing, and wherein said central portion of each said respective seal cover protrudes inwardly into said cavity of said housing from said inner surface of said sealing member body.

4. The waterproof electrical connector according to claim 1, wherein said circumferential portion is preferentially and more easily rupturable than said central portion of each said respective seal cover.

5. The waterproof electrical connector according to claim 4, wherein said thickness of said circumferential portion is thinner than a thickness of said central portion of each said respective seal cover.

6. The waterproof electrical connector according to claim 1, wherein said central portion of each said respective seal cover protruding away from said sealing member body has a hollow bowl shape with a hollow interior communicating continuously with said respective through hole.

7. The waterproof electrical connector according to claim 1, wherein said central portion of each said respective seal cover protruding away from said sealing member body includes a solid non-hollow protruding nub projecting from said end of said respective through hole.

8. The waterproof electrical connector according to claim 1, wherein said circumferential portion of said respective seal cover is entirely rupturable to completely separate said respective seal cover from said sealing member body, thus defining a second condition of said waterproof electrical connector in which said circumferential portion of said respective seal cover is entirely ruptured and said respective seal cover is thereby completely separated and removed from said sealing member body along said circumferential portion which has been entirely ruptured.

9. The waterproof electrical connector according to claim 1, wherein each said respective seal cover further includes a reinforcing part that has a thickness greater than said thickness of said circumferential portion of said respective seal cover, and that extends across said circumferential portion and connects said central portion of said respective seal cover to said sealing member body.

10. The waterproof electrical connector according to claim 9, wherein said reinforcing part resists rupturing when said circumferential portion of said respective seal cover is broken, so that said reinforcing part permanently connects said central portion of said respective seal cover to said sealing member body even when said circumferential portion is broken to open said respective through hole.

11. The waterproof electrical connector according to claim 1, wherein said at least one through hole includes a plurality of said through holes, said at least one seal cover includes a plurality of said seal covers respectively allocated to said through holes, and said sealing member further includes a connecting member that is integrally connected to and permanently interconnects said central portions of a group of said seal covers.

12. A waterproof electrical connector comprising:

a housing with a cavity therein adapted to receive an electrical terminal, and an opening of said housing that communicates into said cavity; and a sealing member including a sealing member body that is inserted in a sealed manner into said opening of said housing, and that has at least one through hole passing therethrough into said cavity, and including at least one seal cover respectively allocated to said at least one through hole;

wherein:

each said through hole is adapted to receive therein in a sealed manner an electric wire connected to the electrical terminal;

each respective said seal cover includes a seal cover central portion and a seal cover circumferential portion that entirely circumferentially surrounds said central portion and that integrally connects said central portion to a circumference of a respective said through hole so that said circumferential portion and said central portion together form said respective seal cover as a continuous closed cover that is integral with said sealing member body and that closes said respective through hole in an initial first condition of said waterproof electrical connector;

said circumferential portion of each said respective seal cover has a thickness that can be broken by applying a human force to said respective seal cover; and said circumferential portion of said respective seal cover is entirely rupturable to completely separate said respective seal cover from said sealing member body, thus defining a second condition of said waterproof electrical connector in which said circumferential portion of said respective seal cover is entirely ruptured and said respective seal cover is thereby completely separated and removed from said sealing member body along said circumferential portion which has been entirely ruptured.

13. The waterproof electrical connector according to claim 12, wherein said circumferential portion is preferentially and more easily rupturable than said central portion of each said respective seal cover.

14. The waterproof electrical connector according to claim 12, wherein said central portion of each said respective seal cover protrudes away from said sealing member body and has a hollow bowl shape with a hollow interior communicating continuously with said respective through hole.

15. The waterproof electrical connector according to claim 12, wherein said central portion of each said respective seal cover protrudes away from said sealing member body and includes a solid non-hollow protruding nub projecting from an end of said respective through hole.

16. The waterproof electrical connector according to claim 12, wherein said at least one through hole includes a plurality of said through holes, said at least one seal cover includes a plurality of said seal covers respectively allocated to said through holes, and said sealing member further includes a connecting member that is integrally connected to and permanently interconnects said central portions of a group of said seal covers.

* * * * *

UNITED STATES PATENT AND TRADEMARK OFFICE

CERTIFICATE OF CORRECTION

PATENT NO. : 6,595,800 B2
DATED : July 22, 2003
INVENTOR(S) : Yuasa et al.

It is certified that error appears in the above-identified patent and that said Letters Patent is hereby corrected as shown below:

Title page,
Item [56], References Cited, U.S. PATENT DOCUMENTS, replace “4,973,298” by -- 4,973,268 --; and “Ferguson” by -- Smith et al. --;

Column 7,
Line 33, after “cell”, replace “12.,” by -- 11, --.

Signed and Sealed this

Eleventh Day of May, 2004

JON W. DUDAS
*Acting Director of the United States Patent and Trademark Office*